US005088415A

United States Patent [19]

Huffman et al.

[11] Patent Number: 5,088,415

[45] Date of Patent: Feb. 18, 1992

[54] ENVIRONMENTALLY IMPROVED SHOT

[75] Inventors: John Huffman; John Shannon, both of Memphis, Tenn.

[73] Assignee: Safety Shot Limited Partnership, Memphis, Tenn.

[21] Appl. No.: 606,814

[22] Filed: Oct. 31, 1990

[51] Int. Cl.[5] ..... F42B 12/80

[52] U.S. Cl. ..... 102/515; 427/216; 427/221; 29/1.23

[58] Field of Search ..... 102/511, 516, 515, 517, 102/518; 427/221, 216; 29/1.22, 1.23; 428/403, 407

[56] References Cited

U.S. PATENT DOCUMENTS

| | | | |
|---|---|---|---|
| 335,464 | 2/1886 | Lorenz | 29/1.23 |
| 4,027,594 | 6/1977 | Olin et al. | 102/517 |
| 4,714,023 | 12/1987 | Brown | 102/516 |

FOREIGN PATENT DOCUMENTS

| | | | |
|---|---|---|---|
| 0010845 | 5/1980 | European Pat. Off. | 102/517 |

*Primary Examiner*—Michael J. Carone

*Attorney, Agent, or Firm*—Oblon, Spivak, McClelland, Maier & Neustadt

[57] ABSTRACT

Environmentally improved alternatives to lead shot are provided that overcoat a lead core with a chemically inert polymer bonded thereto by heating lead shot coated with the polymer above the melting point of the lead shot, or by substituting for lead a combination of dense metal and light metal, and either a core/coating bimetallic sphere relationship or a matrix of light metal provided with powder of a heavy metal embedded therein. The composite shot exhibits a density similar to that of lead.

7 Claims, No Drawings

ENVIRONMENTALLY IMPROVED SHOT

FIELD OF THE INVENTION

This invention is directed to substitute for conventional lead shot that will substantially reduce or eliminate the release of lead or similar toxins to the environment, or to animals ingesting the spent shot. The invention also pertains to a process for preparing that shot.

BACKGROUND OF THE INVENTION

It has long been known that lead shot expended, generally in hunting, that remains in the environment poses a significant toxic problem. The most severe problem presented by the spent lead shot is the ingestion by game fowl, particularly water fowl, of the spent shot for grit. Conventional shot, consisting or consisting essentially of lead, can lead to lead poisoning of the bird ingesting the shot. Estimates of water fowl mortality due to this type of lead poisoning ranges as high as 2-3% of all deaths per year.

These findings have generated a continual search for alternatives to conventional lead shot. Ultimately, steel (soft ron) shot was proposed as a substitute, as it is less expensive than more inert and softer metals (such as gold), resists erosion and produces no toxic effects when exposed to the acid environment of water fowl stomachs. Unfortunately, the cost of steel shot is higher than the cost of lead shot, and the steel is significantly harder than lead shot. As a result, steel shot can damage the barrels of most commercially available shotguns not designed specifically for shooting steel shot. Moreover, being substantially less dense than lead, steel shot is significantly inferior to lead, ballistically. This results in a high increase in the unnecessary loss of wild fowl due to crippling rather than kill shots. This increase has been estimated to be a higher increase in mortality than that due to lead poisoning.

Additionally, lead shot remaining in the environment is a source of lead introduced to the environment, that can be inadvertently included in a variety of food chains, not only water fowl. The natural acidity of rain fall, coupled with many acid environments, leads to leaching of the lead, and potential poisoning of important habitats and environments.

One alternative to conventional lead shot is discussed in U.S. Pat. No. 3,363,561, Irons. As described therein, TEFLON is coated over lead shot, for the purposes of preventing lead poisoning. The process as described for coating the lead shot at column 3, lines 19-45 of the Irons patent, uniformly call for the application of TEFLON at temperatures only up to 400° F. so as to avoid deformation of the shot which starts to lose its shape around 425° F. Polymers exhibiting the levels of corrosion resistance and abrasion resistance necessary to be effective in significantly reducing or eliminating lead leaching require temperatures in excess of 400° F. to cure and bond satisfactorily. Most of the processes call for temperatures about 400° F. This results in a thin coating of polymer about an internal lead shot, but no significant bonding between the polymer and the shot. As a result, the polymer is easily peeled from the shot, and in fact, significant erosion or destruction of the polymer coating can occur in the mechanical environment of the shotgun barrel. Accordingly, this alternative has not received success in the industry.

It therefore remains a goal of those of skill in the art to provide ballistically acceptable, environmentally safe and lead erosion-free shot.

SUMMARY OF THE INVENTION:,

This invention provides shot which yields no, or remarkably low, leaching of lead shot, according to established standards. These and other objects of the invention are achieved in a variety of embodiments.

As one preferred alternative embodiment, conventional lead shot is coated with a substantially inert, chemical and abrasion-resistant polymer, such as TEFLON, or its fluorinated polymer variants. The TEFLON is baked in an environment which supports the shape of the lead shot, at a temperature above the melting point of the lead shot. This allows the polymer to be heated to the temperature required to optimally cure and bond the polymer without deformation occurring to the lead shot. Additionally, as the molten shot with the baked polymer coating is allowed to cool, there is an opportunity for mechanical bonding at the lead-polymer interface. As the molten shot with the baked polymer coating is allowed to cool, chemical as well as mechanical bonding occurs at the interface of the lead shot and the coating. As a result, the coating is substantially more adherent to the shot than prior art attempts, giving a dramatic reduction in lead leached from the shot under standard testing methodology.

In a second alternative, metals with a specific gravity greater than lead, particularly tungsten or depleted uranium (Udep) are provided with an outer coating of an alternative metal or metal alloy, such as zinc, bismuth, aluminum, tin, copper, iron, nickel or alloys, which when coated about the denser core, will result in an average density comparable to that of lead, e.g., 11.35. This process will also allow average densities of between 9.0 and 17.5 to be obtained which may be desirable for special applications.

In a third alternative, a molten preparation of a lighter metal, such as those mentioned above with respect to the bimetallic sphere embodiment, is provided with a powder of denser metals, such as tungsten or depleted uranium. As the melting point of tungsten is substantially above the melting points for all the metals and metal alloys mentioned, and the melting point for depleted uranium is above the majority of the metals and metal alloys mentioned, the resulting suspension can be formed into concentric spheres by conventional methods.

In these two latter embodiments, as the shot contains no lead, it cannot release any lead to the environment or animal ingesting the shot. Moreover, the majority of the alternative metals or metal alloys will yield a coating or matrix alloy that is sufficiently soft to be useful in conjunction with existing shotgun barrels. The density can be matched to that of lead, by proper adjustment of the concentration of the heavier and lighter metals.

DETAILED DESCRIPTION OF THE INVENTION:

The shot that is the subject of this invention can be prepared in any dimension, and is desirably prepared in dimensions identical to that of current commercially offered lead or iron shot. Conventional shot is generally prepared by dropping molten lead or other metal preparation through a "shot tower". In this process, a preparation of molten metal is directed to a sieve positioned at a substantial height over a cooling bath, such as water or oil. As the molten metal, e.g., lead, falls through the shot tower, leaving the sieve, it naturally forms a sphere, and gradually cools in its passage down the tower, which may be as much as 120 feet or more. Finally, it is quenched in the cooling bath, which maintains the spherical shape of the shot.

In the first embodiment, providing lead shot with a mechanically and chemically bound inert polymer coating, shot prepared according to this method may be used. Conventionally prepared shot can simply be overcoated with a polymer coating, either including a solvent or solventless. Preferred polymers include fluorinated polymers such as TEFLON (polytetraflouroethylene) and related polyfluoro compounds offering superior performance values. These include using enhanced polymers, where the polymer either includes a secondary resin or includes a resin primer to improve adhesion. The coated shot is then embedded in a medium which provides uniform support to maintain the spherical shape of the shot, even if the shot itself becomes molten. A variety of substances can be used to provide the support beds. Preferably among support bed materials are casting compounds, fine silica or glass beads, gels, columns of air, and similar materials. The shot is raised to a temperature above the melting or deformation point of the shot itself. This allows the polymer to be heated to the temperature required to optimally cure and bond the polymer without deformation occurring to the lead shot. Additionally, as the molten shot with the baked polymer is allowed to cool, which cooling can be accelerated by air exchange, there is an opportunity for mechanical bonding at the lead-polymer interface. In the alternative, to prepare the coated shot, the atmosphere of the shot tower is provided with an aerosol fog of polymer. These aerosols are prepared according to conventional methods and do not constitute an aspect of this invention, per se. The molten lead droplets, as they exit the sieve fall through the fog and are coated with the polymer. The intrinsic heat of the molten droplets bonds the polymer to the shot as it is formed at the temperature required to optimally cure and bond the polymer. Additionally, as the molten droplets cool, there is an opportunity for mechanical bonding at the lead-polymer interface. The coated process can be enhanced by utilizing electrostatic spraying and coating techniques. This process has the advantage of coating the shot without introduction of separate processing steps. Thus, the shot is insulated from the environment, with an inert polymer which resists peeling or erosion.

To demonstrate the superior safety and lead leaching-resistance of the inventive shot, a series of comparisons were made, preparing shot coated with TEFLON available from duPont and similar fluorinated polymer available from Whitford under the name Whitford 1014, a resin enhanced fluorinated polymer, compared according to conventional procedures which call for baking of the polymer at 400° F. for 20 minutes, as opposed to higher temperatures, as reflected in the graphs following. The shot so prepared was subjected to a variation of the standardized test for erosion rate, prescribed by Regulation, 50 CFR 20.134 (C) specifically referencing Kimball et al. *Journal of Wildlife Management* 35 (2), 360–365 (1971). Specifically, pursuant to the regulations identified hydrochloric acid is added to each capped test tube in a volume and concentration that will erode a single No. 4 lead shot at a minimum rate of 5 mg/day. Test tubes, each containing either conventional lead shot or the inventive shot, are placed in a water bath on a stirring hot plate. A TEFLON coated magnet is added to each test tube, and the hot plate is set at 42° C and 500 rpm. Erosion of shot is determined on a daily basis for 14 consecutive days by analyzing the digestion solution with an atomic absorption spectrophotometer. The shot are all weighed at the end of the 14-day period to confirm cumulative weight loss. The 14-day procedure is repeated. Specific statistical analysis are required by the regulation. This variation is actually more severe than that prescribed by regulation.

As demonstrated by the foregoing comparative data, shot coated with an inert polymer according to the claimed invention exhibits superior erosion characteristics releasing substantially reduced amounts of lead, under standardized testing.

| | gr5-1 DuPont coating using conventional curing at maximum conventional temperature - 400 F. for 20 min. | | | | | |
|---|---|---|---|---|---|---|
| day | control shot | gr5-1-1 | gr5-1-2 | gr5-1-3 | gr5-1-4 | gr5-1-5 |
| 1 | 899.2 | 610 | 647.8 | 775.3 | 569.3 | 784 |
| 2 | 814.9 | 852.1 | 763.3 | 879.3 | 733.2 | 897.8 |
| 3 | 763.5 | 748 | 719 | 727.5 | 711 | 771 |
| 4 | 533.3 | 549.7 | 615.4 | 626.5 | 551.1 | 479.6 |
| 5 | 709.9 | 735.1 | 747.9 | 736.3 | 776.8 | 785.4 |
| 6 | 791.6 | 779.9 | 840.1 | 671.6 | 806.3 | 748.1 |
| 7 | 666.9 | 776.5 | 719.9 | 641.7 | 741.1 | 821.5 |
| 8 | 711.1 | 731.9 | 755.9 | 775.6 | 795 | 763.2 |
| 9 | 918.2 | 833 | 878 | 861.5 | 862.8 | 802.9 |
| 10 | 774.4 | 838 | 892.4 | 836 | 867 | 817.8 |
| 11 | 706.4 | 780.5 | 849.1 | 791.5 | 840.6 | 898.1 |
| 12 | 791.4 | 924 | 878.3 | 695.9 | 901.6 | 851.3 |
| 13 | 764.6 | 831.7 | 860.9 | 463 | 687.1 | 723 |
| 14 | 600.1 | 822.9 | 791.8 | 813.7 | 900.2 | 892.3 |
| total ppm | 10445.5 | 10813.3 | 10959.8 | 10295.4 | 10743.1 | 11036.0 |
| pct. of control | | 103.521 | 104.924 | 98.563 | 102.849 | 105.653 |
| mean pct. | | | | 103.102 | | |
| median pct. | | | | 103.521 | | |

| | gr1-1 DuPont coating using embedded curing at temperature above conventional - 400 F. for 20 min. then 525 F. for 20 min. (control ppm is projected and is believed to be low) | | | | | |
|---|---|---|---|---|---|---|
| day | control shot | gr1-1-1 | gr1-1-2 | gr1-1-3 | gr1-1-4 | gr1-1-5 |
| 7 | — | 4.2 | 1.7 | 3.1 | 5.8 | 12 |

-continued

| | | | | | | |
|---|---|---|---|---|---|---|
| 9 | — | 10 | 7 | 8 | 33 | 52 |
| 11 | — | 4.1 | 4.3 | 3.9 | 21.2 | 46.9 |
| 14 | — | 5 | 4 | 13 | 58 | 92 |
| total ppm | 5000.0 | 23.3 | 17.0 | 28.0 | 118.0 | 202.9 |
| pct. of control | | 0.466 | 0.340 | 0.560 | 2.360 | 4.058 |
| mean pct. | | | | 1.557 | | |
| median pct. | | | | 0.56 | | |

gr4-1 DuPont coating using embedded curing at temperature above conventional - 400 F. for 20 min. then 625 F. for 20 min.

| day | control shot | gr4-1-1 | gr4-1-2 | gr4-1-3 |
|---|---|---|---|---|
| 2 | 717 | 16 | 8 | 12 |
| 4 | 670 | 23.4 | 13.2 | 14.5 |
| 7 | 690 | 37 | 25 | 25 |
| 8 | 508.4 | 17.3 | 16 | 14.4 |
| 9 | 509.4 | 16.9 | 15.2 | 11.7 |
| 10 | 509 | 12.9 | 12.7 | 11.5 |
| 11 | 551.6 | 18.7 | 19.3 | 19.5 |
| 12 | 361.2 | 13.7 | 14.6 | 14.4 |
| 13 | 287.6 | 16 | 15 | 16.4 |
| 14 | 208 | 15.3 | 14.4 | 14.4 |
| total ppm | 5012.2 | 187.2 | 153.4 | 153.8 |
| pct. of control | | 3.735 | 3.061 | 3.069 |
| mean pct. | | | 2.388 | |
| median pct. | | | 3.069 | |

gr4-2 Dupont coating using embedded curing at temperature above oonventional - 400 F. for 20 min. then 625 F. for 20 min.

| day | control shot | gr4-2-1 | gr4-2-2 | gr4-2-3 |
|---|---|---|---|---|
| 2 | 720 | 6 | 3 | 15 |
| 4 | 686 | 4.3 | 1.8 | 14.4 |
| 7 | 690 | 3 | 2 | 28 |
| 8 | 390.1 | 2 | 2.3 | 12.5 |
| 9 | 382.8 | 2.2 | 1.3 | 13 |
| 10 | 381.9 | 1.3 | 1.7 | 11 |
| 11 | 656.3 | 1.9 | 3.7 | 16 |
| 12 | 586.5 | 0.6 | 2 | 9.6 |
| 13 | 775.2 | 3 | 4 | 14 |
| 14 | 611.7 | 0.9 | 1.6 | 11.4 |
| total ppm | 5880.5 | 25.2 | 23.4 | 144.9 |
| pct. of control | | 0.429 | 0.398 | 2.464 |
| mean pct. | | | 1.097 | |
| median pct. | | | 0.429 | |

px4-1 whitford coating using conventioanl curing at maximum conventional temperature - 400 degrees F. for 30 min.

| day | control shot | px4-1-1 | px4-1-2 | px4-1-3 | px4-1-4 | px4-1-5 |
|---|---|---|---|---|---|---|
| 1 | 831.2 | 194.2 | 696.1 | 365.3 | 697.9 | 424.1 |
| 2 | 814.6 | 712.1 | 823.5 | 829.9 | 847.7 | 766.5 |
| 3 | 861.2 | 806.2 | 785.9 | 842.3 | 819.3 | 859.7 |
| 4 | 771.6 | 783 | 704.6 | 753.6 | 691.8 | 731.4 |
| 5 | 704.8 | 817.8 | 759.8 | 731.1 | 820.4 | 810 |
| 6 | 640.8 | 714.2 | 647.3 | 766.5 | 758.7 | 673.2 |
| 7 | 772.6 | 777.5 | 761.1 | 551.6 | 786.7 | 770.5 |
| 8 | 718.6 | 480.8 | 758.5 | 552.9 | 498.1 | 803.3 |
| 9 | 957.8 | 455.3 | 984 | 937.8 | 483.3 | 441.8 |
| 10 | 806.1 | 406.6 | 915.3 | 805.9 | 879.7 | 856 |
| 11 | 1065 | 423.1 | 886.9 | 847.2 | 944.6 | 869.7 |
| 12 | 812.4 | 631.4 | 975 | 885.7 | 942.1 | 938.8 |
| 13 | 869.2 | 515.9 | 1021 | 1026 | 977.7 | 861.2 |
| 14 | 679.3 | 764.1 | 947.6 | 894.1 | 660.8 | 735.9 |
| total ppm | 11305.2 | 8482.2 | 11666.6 | 10789.9 | 10808.8 | 10542.1 |
| pct. of control | | 75.029 | 103.197 | 95.442 | 95.609 | 93.250 |
| mean pct. | | | 92.505 | | | |
| median pct. | | | 95.442 | | | |

px1-1 whitford coating using conventional curing at maximum conventional temperature - 400 degree F. for 30 min.

| day | control shot | px1-1-1 | px1-1-2 | px1-1-3 |
|---|---|---|---|---|
| 1 | 706.3 | 0.7 | 0.6 | 0 |
| 2 | 865.5 | 114.5 | 15.4 | 6.2 |
| 3 | 1250 | 270.8 | 31.3 | 7 |
| 4 | 745.4 | 689.3 | 157.4 | 20.5 |
| 5 | 734.1 | 616 | 182.4 | 31.3 |
| 6 | 457.4 | 699.9 | 275.7 | 55.6 |
| 7 | 600.8 | 711.2 | 478.7 | 111.4 |
| 8 | 666.7 | 680.8 | 524.6 | 179.3 |

-continued

| | | | | |
|---|---|---|---|---|
| 9 | 599.2 | 648.1 | 624.6 | 207.9 |
| 10 | 582.9 | 682.9 | 680 | 316 |
| 11 | 660.9 | 692.5 | 606.4 | 434.1 |
| 12 | 654.2 | 789.7 | 778.5 | 767.5 |
| 13 | 936 | 931.9 | 922.1 | 915.8 |
| 14 | 598 | 598 | 705.2 | 593.1 |
| total ppm | 10057.4 | 8126.3 | 5982.9 | 3645.7 |
| pct. of control | | 80.799 | 59.488 | 36.249 |
| mean pct. | | | 58.845 | |
| median pct. | | | 59.488 | |

px1-2 whitford coating using conventional curing at maximum conventional temperature - 400 degree F. for 30 min.

| day | control shot | px1-2-1 | px1-2-2 | px1-2-3 | px1-2-4 | px1-2-5 |
|---|---|---|---|---|---|---|
| 1 | 1070 | 218 | 129.6 | 101.4 | 2.1 | 9.9 |
| 2 | 1140 | 467 | 258.4 | 431.5 | 5.4 | 12.5 |
| 3 | 1050 | 1122 | 933.6 | 1140 | 18.6 | 235.3 |
| 4 | 1068 | 1050 | 691.6 | 1150 | 27.3 | 1000 |
| 5 | 1023 | 1048 | 1067 | 1056 | 99.1 | 943.6 |
| 6 | 1115 | 1170 | 992.2 | 1133 | 214.2 | 1035 |
| 7 | 1100 | 1013 | 989.7 | 1032 | 360 | 1020 |
| 8 | 1040 | 1075 | 1050 | 1065 | 487.7 | 976.9 |
| 9 | 1170 | 1114 | 1109 | 1050 | 1025 | 1137 |
| 10 | 1050 | 1144 | 1080 | 1036 | 1042 | 1058 |
| 11 | 1094 | 1111 | 1096 | 1093 | 1004 | 1129 |
| 12 | 1130 | 1048 | 1121 | 1170 | 1092 | 1104 |
| 13 | 1015 | 824.5 | 758 | 1073 | 1010 | 728.7 |
| 14 | 964.8 | 904.1 | 955.1 | 953.7 | 915.8 | 933.9 |
| total ppm | 15029.3 | 13308.6 | 12231.2 | 13484.6 | 7303.2 | 11323.8 |
| pct. of control | | 88.551 | 81.382 | 89.722 | 48.593 | 75.345 |
| mean pct. | | | 86.552 | | | |
| median pct. | | | 81.382 | | | |

px3-1 whitford coating using embedded curing at temperature above conventional - 450 F. for 10 min. then 625 F. for 6 min.

| day | control shot | px3-1-1 | px3-1-2 | px3-1-3 |
|---|---|---|---|---|
| 1 | 736.3 | 0 | 0 | 0 |
| 2 | 821.7 | 0 | 0 | 0 |
| 3 | 1450 | 1.5 | 1.2 | 4.1 |
| 4 | 678.9 | 0.2 | 0 | 7.5 |
| 5 | 818.9 | 0 | 0 | 4.7 |
| 6 | 663.6 | 0.3 | 0 | 6.2 |
| 7 | 683.9 | 0 | 0 | 11.6 |
| 8 | 606.4 | 0 | 0 | 11 |
| 9 | 616.6 | 0 | 0 | 12 |
| 10 | 674.1 | 0 | 0 | 24.8 |
| 11 | 748.1 | 0 | 0 | 28.6 |
| 12 | 631 | 1.7 | 0 | 51.3 |
| 13 | 871.7 | 10.4 | 0.8 | 107.5 |
| 14 | 730.6 | 13.5 | 4.6 | 245.3 |
| total ppm | 10731.8 | 27.600 | 6.600 | 514.600 |
| pct. of control | | 0.257 | 0.061 | 4.795 |
| mean pct. | | | 1.705 | |
| median pct. | | | 0.257 | |

px3-3 whitford coating using embedded curing at temperature above conventional - 450 F. for 10 min. then 625 F. for 6 min.

| day | control shot | px3-3-1 | px3-3-2 | px3-3-3 |
|---|---|---|---|---|
| 1 | 900.6 | 0 | 0 | 0 |
| 2 | 729.1 | 0 | 13.8 | 0 |
| 3 | 704.9 | 0 | 16.8 | 0 |
| 4 | 714.5 | 0 | 18.6 | 0 |
| 5 | 715.3 | 0 | 21.5 | 0 |
| 6 | 684.8 | 0.5 | 24.5 | 0 |
| 7 | 752.2 | 2 | 23.9 | 0 |
| 8 | 627.8 | 5.7 | 40.8 | 0.3 |
| 9 | 848.4 | 9.8 | 52.2 | 18 |
| 10 | 1050 | 8.5 | 66.4 | 16.1 |
| 11 | 946.5 | 7.7 | 87.7 | 13.6 |
| 12 | 826.7 | 4.3 | 21.8 | 8.9 |
| 13 | 971.8 | 5.6 | 228.6 | 20.6 |
| 14 | 398.1 | 3.1 | 193.1 | 12.5 |
| total ppm | 11410.7 | 47.2 | 809.7 | 90.0 |
| pct. of control | | 0.414 | 7.096 | 0.789 |
| mean pct. | | | 2.766 | |
| median pct. | | | 0.789 | |

px6-1 whitford coating using embedded curing at temperature above conventional - 450 F. for 10 min. then 625 F. for 6 min.

-continued

| day | control shot | px6-1-1 | px6-1-2 | px6-1-3 |
|---|---|---|---|---|
| 1 | 775.2 | 0 | 0 | 0.5 |
| 2 | 611.7 | 0 | 3.5 | 1 |
| 3 | 740.1 | 0 | 11.6 | 0.7 |
| 4 | 714.1 | 0 | 20.3 | 1.7 |
| 5 | 706.2 | 0 | 26.1 | 8.9 |
| 6 | 584.9 | 0 | 28.8 | 19.1 |
| 7 | 904.7 | 0 | 42 | 10.1 |
| 8 | 939 | 0 | 35.9 | 14.4 |
| 9 | 747.7 | 0 | 52.6 | 20.1 |
| 10 | 844.1 | 0.3 | 52.3 | 13.6 |
| 11 | 614.3 | 0.9 | 82.3 | 19.1 |
| 12 | 715.6 | 1.7 | 136.9 | 21.2 |
| 13 | 744.7 | 1.1 | 204.4 | 20.7 |
| 14 | 718.8 | 3.2 | 282.3 | 29.9 |
| total ppm | 10361.1 | 7.2 | 979.0 | 181.0 |
| pct. of control | | 0.069 | 9.449 | 1.747 |
| mean pct. | | | 3.755 | |
| median pct. | | | 1.747 | |

px7-2 whitford coating using embedded curing at temperature above conventional - 450 F. for 10 min. then 700 F. for 3 min.

| day | control shot | px7-2-1 | px7-2-2 | px7-2-3 |
|---|---|---|---|---|
| 1 | 714.1 | 0.9 | 3.2 | 0 |
| 2 | 706.2 | 2.6 | 11.3 | 0 |
| 3 | 584.9 | 1.9 | 13.3 | 0 |
| 4 | 904.7 | 3.2 | 12.5 | 0 |
| 5 | 939 | 16.7 | 18.2 | 0.2 |
| 6 | 747.7 | 18.9 | 18.7 | 0 |
| 7 | 844.1 | 15.6 | 18.1 | 0 |
| 8 | 614.3 | 14.3 | 18.7 | 0.1 |
| 9 | 715.6 | 30.7 | 17.5 | 0 |
| 10 | 744.7 | 33.7 | 20.5 | 0.1 |
| 11 | 718.8 | 20.1 | 25.1 | 0.1 |
| 12 | 653.4 | 27 | 29.9 | 0.5 |
| 13 | 720.2 | 23.3 | 24.5 | 0.4 |
| 14 | 706.7 | 26.5 | 23.2 | 26.3 |
| total ppm | 10314.4 | 235.4 | 254.7 | 27.7 |
| pct. of control | | 2.282 | 2.469 | 0.269 |
| mean pct. | | | 1.673 | |
| median pct. | | | 2.282 | |

px7-3 whitford coating using conventional curing at temperature above conventional - 450 degrees F. for 10 min. then 700 F. for 3 min.

| day | control shot | px7-3-1 | px7-3-2 | px7-3-3 | px7-3-4 | px7-3-5 |
|---|---|---|---|---|---|---|
| 1 | 669.2 | 2.5 | 0 | 0 | 0.3 | 0 |
| 2 | 843.6 | 2.2 | 0.4 | 0 | 0.3 | 0 |
| 3 | 945.3 | 10.2 | 0.8 | 0 | 4.3 | 0 |
| 4 | 1088 | 15.6 | 2 | 0.5 | 6.6 | 0 |
| 5 | 539.8 | 20.6 | 3.3 | 1.4 | 7 | 0 |
| 6 | 981.9 | 51.7 | 2 | 0.9 | 9.8 | 0 |
| 7 | 1025 | 32.2 | 48.6 | 3.3 | 8.4 | 0.1 |
| 8 | 1038 | 34.6 | 19.4 | 1.5 | 10.7 | 6.6 |
| 9 | 982.3 | 34.5 | 31.2 | 19.1 | 12.9 | 8.6 |
| 10 | 1010 | 44.1 | 38.1 | 20 | 16.7 | 15.6 |
| 11 | 769.1 | 42.3 | 39.8 | 8.5 | 14.8 | 9.8 |
| 12 | 1400 | 45.8 | 45.5 | 10.5 | 13.7 | 14.9 |
| 13 | 1211 | 46.1 | 57.1 | 9.3 | 11.8 | 18.8 |
| 14 | 994.7 | 54.1 | 99.7 | 10 | 16.2 | 27.8 |
| total ppm | 13497.9 | 436.5 | 387.9 | 85.0 | 133.5 | 102.2 |
| pct. of control | | 3.234 | 2.874 | 0.630 | 0.989 | 0.757 |
| mean pct. | | | 1.697 | | | |
| median pct. | | | 0.989 | | | |

px8-1 whitford coating using conventional curing at temperature above conventional - 450 degrees F. for 30 min.

| day | control shot | px8-1-1 | px8-1-2 | px8-1-3 |
|---|---|---|---|---|
| 1 | 640.7 | 0 | 3 | 0.4 |
| 2 | 724.3 | 0.1 | 7.5 | 0 |
| 3 | 731.6 | 0 | 6.3 | 4.1 |
| 4 | 770.5 | 0 | 32.8 | 7 |
| 5 | 964.7 | 0 | 84.3 | 6.3 |
| 6 | 667.1 | 2.4 | 153.5 | 7.1 |
| 7 | 713.3 | 0.4 | 130.7 | 11.2 |
| 8 | 726.1 | 0.2 | 178.8 | 9.3 |
| 9 | 674.9 | 13 | 210.3 | 16.2 |
| 10 | 809.7 | 12.4 | 175.9 | 21.7 |

-continued

| | | | | |
|---|---|---|---|---|
| 11 | 826.9 | 21 | 247.1 | 48.9 |
| 12 | 686 | 16.8 | 277.7 | 53.6 |
| 13 | 653.7 | 15.1 | 263.8 | 55.8 |
| 14 | 722 | 13.8 | 307.3 | 72.4 |
| total ppm | 10311.5 | 95.2 | 2079.0 | 314.0 |
| pct. of control | | 0.923 | 20.162 | 3.045 |
| mean pct. | | | 8.043 | |
| median pct. | | | 3.045 | |

| | px8-2 whitford coating using embedded curing at temperature above conventional - 450 F. for 30 min. | | | | | |
|---|---|---|---|---|---|---|
| day | control shot | px8-2-1 | px8-2-2 | px8-2-3 | px8-2-4 | px8-2-5 |
| 1 | 599.8 | 0 | 0 | 2.1 | 0 | 1.9 |
| 2 | 905.2 | 0 | 0 | 9.9 | 0 | 3.5 |
| 3 | 912.7 | 0 | 0 | 18.9 | 3.2 | 11.2 |
| 4 | 1014 | 0 | 0 | 29.9 | 2.2 | 13.6 |
| 5 | 534.5 | 0 | 0 | 25.9 | 2.5 | 10 |
| 6 | 1095 | 1.4 | 0.1 | 65.3 | 16.1 | 22.9 |
| 7 | 658.6 | 0.3 | 0.1 | 52.8 | 13.1 | 14.4 |
| 8 | 626.1 | 0.3 | 0.3 | 72.8 | 18.9 | 23.9 |
| 9 | 985.2 | 0.5 | 0.2 | 82.2 | 17.4 | 32.6 |
| 10 | 1050 | 0.6 | 0.2 | 89.4 | 26.1 | 35.8 |
| 11 | 945.4 | 0.4 | 0.5 | 108.6 | 36.6 | 58 |
| 12 | 1160 | 4.6 | 2.4 | 119.3 | 27.6 | 49.6 |
| 13 | 1099 | 6.8 | 10.4 | 135.3 | 37.9 | 69.8 |
| 14 | 977.9 | 34.5 | 44.6 | 167.3 | 35.3 | 94.1 |
| total ppm | 12563.4 | 49.4 | 58.8 | 979.7 | 236.9 | 441.3 |
| pct. of control | | 0.393 | 0.468 | 7.798 | 1.886 | 3.513 |
| mean pct. | | | 2.812 | | | |
| median pct. | | | 1.886 | | | |

In alternative embodiments, lead is replaced as an element of the shot. In a first alternative, a core of a relatively dense metal, i.e., a metal with a specific gravity greater than that of lead, greater than 11.35, is overcoated with a less dense metal, which is not environmentally toxic. Among the metals that exhibit a specific gravity above 11.35, only uranium dep. and tungsten present realistic alternatives. The remaining alternatives are set forth in the following Table.

| METALS WITH SPECIFIC GRAVITY GREATER THAN LEAD - 11.35 | | | | | | |
|---|---|---|---|---|---|---|
| Metal | Symbol | Specific Gravity | Melting Point C. | Rare or Precious | Radio-active | Pyro-phoric |
| Americium | Am | 13.67 | 994 | yes | yes | no |
| Curium | Cm | 13.51 | 1340 | yes | yes | no |
| Gold | Au | 19.32 | 1064 | yes | no | no |
| Hafnium | Hf | 13.31 | 2227 | yes | no | yes |
| Iridium | Ir | 22.42 | 2410 | yes | no | no |
| Mercury | Hg | 13.55 | −39 | liquid | no | no |
| Neptunium | Np | 20.25 | 640 | yes | yes | no |
| Osmium | Os | 22.57 | 3045 | toxic | no | no |
| Palladium | Pd | 12.02 | 1552 | yes | no | no |
| Platinum | Pt | 21.45 | 1772 | yes | no | no |
| Plutonium | Pu | 19.84 | 641 | yes | yes | no |
| Protactinium | Pa | 15.37 | 1600 | yes | yes | no |
| Rhenium | zre | 21.02 | 3180 | yes | no | no |
| Rhodium | Rh | 12.41 | 1966 | yes | no | no |
| Ruthenium | Ru | 12.41 | 2310 | yes | no | no |
| Tnatalum | Ta | 16.65 | 2996 | yes | no | no |
| Technetium | Tc | 11.5 | 2172 | yes | yes | no |
| Thallium | Tl | 11.85 | 303 | yes | no | no |
| Thorium | Th | 11.72 | 1750 | yes | yes | no |
| Tungsten | W | 19.3 | 3410 | no | no | no |
| Uranium (dep.) | U (dep.) | 18.95 | 1132 | no | no | yes |

Among metals having a lower specific density than lead for use as metals that may be provided as the outer coating about the W or U dep. core are zinc, bismuth, aluminum, tin, copper, nickel, iron or alloys made thereof. The proportion of core to coating will vary on the density of the metal forming the outer coating. If using tungsten as an example, if bismuth is selected, the tungsten will constitute 16.3% of the shot, while tungsten will constitute 52.1% (by weight) if the outer coating is formed of aluminum. As the core materials have extremely high melting points, 3410° C. for tungsten and 1132° C. for depleted uranium, the cores can be coated by conventional coating techniques, using metal or metal alloy baths, as described.

In a second non-lead containing alternative, the relatively light metals and alloys thereof described above are prepared in a molten bath and a powder of either W or U dep. is introduced thereto, creating a suspension of the denser metal in the lighter molten metal. This molten suspension may be formed into concentric spheres, again by a variety of methods, but most preferably, dropping through conventional shot towers, as lead shot is currently produced. Again, relative weights of the lighter and denser metals should be selected to give an average specific gravity equal to that of lead. In this respect, it should be known that selection of softer metals, such as tin, will give improved acceptability, although alloys made from any of the above-identified metals or the metals themselves, will be softer than the steel shot of the prior art.

This invention has been disclosed in terms of general descriptions, as well as reference to specific examples. Modifications and alternatives, particularly with regard to the identity of the chemically resistant polymer, ratios of metals, etc., will occur to those of ordinary skill in the art without the exercise of inventive faculty. These alternatives remain within the scope of the invention, save as excluded by the limitations of the claims appended hereto.

What is claimed is:

1. Ballistic shot comprised of a spherical core of lead provided with a coating of chemically resistant and abrasion-resistant polymer thereabout, said polymer having been applied to said lead core, said coated core then being heated above the melting point of the core, which allows the polymer to be heated to the temperature required to optimally cure and bond the polymer without deformation occurring to the lead shot, said molten shot with the baked polymer coating being allowed to cool for mechanical bonding at the lead-polymer interface.

2. The shot of claim 1, wherein said polymer is a fluorinated polymer.

3. The shot of claim 2, wherein said fluorinated polymer is polytetrafluoroethylene.

4. A method of making lead shot provided with a coating of chemically and abrasion-resistant polymer, comprising forming a spherical core of lead with a coating of polymer thereabout, supporting said coated core in a bed of shape-supporting material, heating said coated, supported lead to a temperature above the melting point of said lead sufficient to cure said polymer, and cooling said coated lead.

5. The process of claim 4, wherein said lead core is first formed, and then coated with polymer.

6. A process for making lead shot provided with a coating of chemically and abrasion-resistant polymer, comprising forming a spherical core of lead by passing droplets of molten lead through a tower, said tower being provided with an atmosphere of said polymer in aerosol form, allowing said droplets to pass through said atmosphere, and receiving said droplets in a quenching bath.

7. The process of claim 6, wherein said droplet and said aerosol are provided with opposite electrical charges.

* * * * *